US007857308B2

(12) United States Patent
Nakazawa et al.

(10) Patent No.: US 7,857,308 B2
(45) Date of Patent: Dec. 28, 2010

(54) OFF-CENTER ADJUSTMENT APPARATUS

(75) Inventors: Shinji Nakazawa, Kyoto (JP); Yoshiharu Yoneda, Nara (JP)

(73) Assignee: Sharp Corporation, Osaka (JP)

( * ) Notice: Subject to any disclaimer, the term of this patent is extended or adjusted under 35 U.S.C. 154(b) by 659 days.

(21) Appl. No.: 11/808,204

(22) Filed: Jun. 7, 2007

(65) Prior Publication Data

US 2007/0284810 A1 Dec. 13, 2007

(30) Foreign Application Priority Data

Jun. 9, 2006 (JP) ..... 2006-161290

(51) Int. Cl.
*B65H 9/16* (2006.01)
*B65H 7/02* (2006.01)

(52) U.S. Cl. ..... 271/252; 271/228

(58) Field of Classification Search ..... 271/252, 271/248, 249; 193/35 B
See application file for complete search history.

(56) References Cited

U.S. PATENT DOCUMENTS 2,836,417 A * 5/1958 Gericke ..... 271/252
4,823,159 A * 4/1989 Yamamoto et al. ..... 399/394
5,219,159 A * 6/1993 Malachowski et al. ..... 271/228
5,273,274 A * 12/1993 Thomson et al. ..... 271/228
6,019,365 A * 2/2000 Matsumura ..... 271/227
6,059,285 A * 5/2000 Suga et al. ..... 271/228
7,195,238 B2 * 3/2007 Suga et al. ..... 271/228
2005/0035536 A1 * 2/2005 Suga et al. ..... 271/226
2005/0179197 A1 * 8/2005 Able et al. ..... 271/258.01

FOREIGN PATENT DOCUMENTS

JP 2-18244 A 1/1990
JP 05124752 * 5/1993
JP 6-16284 A 1/1994
JP 2005-35766 A 2/2005
JP 2005-67806 A 3/2005

* cited by examiner

*Primary Examiner*—Stefanos Karmis
*Assistant Examiner*—Patrick Cicchino
(74) *Attorney, Agent, or Firm*—Birch Stewart, Kolasch & Birch, LLP

(57) ABSTRACT

According to an embodiment, an idler roller has an insertion through-hole through which a rotation shaft is inserted. Collar-shaped stopper portions are formed on the rotation shaft and are located on both left and right sides of the idler roller when the rotation shaft is inserted and provided at a normal position. Coil springs are attached between the stopper portions and base surfaces of concave groove portions of the idler roller. The idler roller is held at the normal position by biasing force of both the coil springs when paper is not seized. When paper is seized, the idler roller is moved in a lateral direction by elastic restoring force caused by a torsion phenomenon occurring in the paper. The idler roller returns to the normal position due to biasing force of both the coil springs after the paper has passed through the idler roller.

7 Claims, 5 Drawing Sheets

FIG.6 Conventional Art
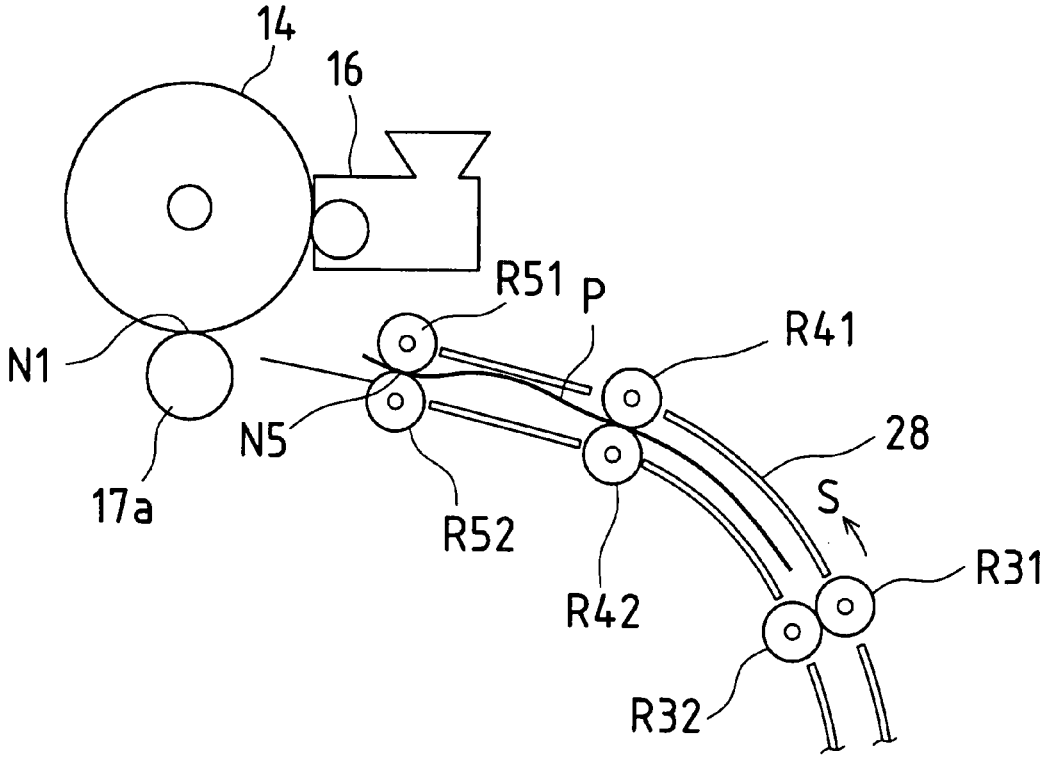
FIG.7(a)
Conventional Art
FIG.7(b)
Conventional Art
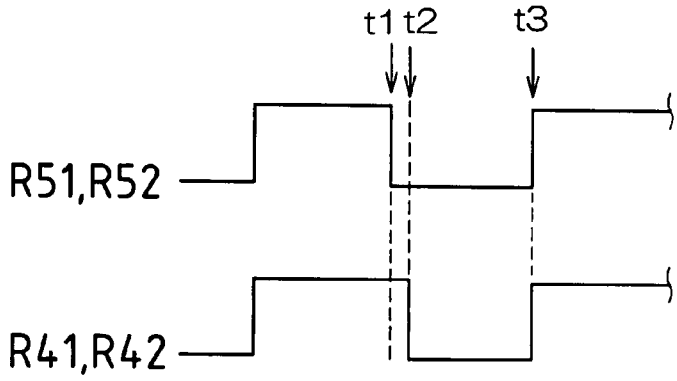

OFF-CENTER ADJUSTMENT APPARATUS

CROSS REFERENCE TO RELATED APPLICATIONS

This application claims priority under 35 U.S.C. §119(a) on Patent Application No. 2006-161290 filed in Japan on Jun. 9, 2006, the entire contents of which are hereby incorporated by reference.

BACKGROUND OF THE INVENTION

1. Field of the Invention

The present invention relates to an off-center adjustment apparatus in which registration rollers and pre-registration rollers are provided upstream from an electrostatic latent image carrier, a front end of transported paper is seized by the registration rollers and a rear end thereof is seized by the pre-registration rollers so as to temporarily stop the paper, and in this state, the registration rollers are moved in a direction perpendicular to a paper transport direction, thereby performing center position adjustment in the direction perpendicular to the paper transport direction.

2. Description of the Related Art

In recent years, longitudinal transport type image forming apparatuses have become the mainstream because they require less installation space. Specifically, a plurality of paper feed cassettes stacked vertically are provided in a lower portion of the main body of the apparatus, and a transfer portion and a fixing portion are provided in an upper portion of the main body. In such a structure, transported paper fed from the paper feed cassette is temporarily transported upward and, thereafter, is bent by about 90 degrees before the transfer portion so that the transport direction is converted into a horizontal direction before being transported toward the transfer portion.

FIG. 6 shows a configuration of a paper transport path before the transfer portion.

The paper transport path 28, which is bent as described above, comprises a pair of transport rollers R31 and R32, a pair of pre-registration rollers R41 and R42, and a pair of registration rollers R51 and R52, which are arranged sequentially along a paper transport direction S. The registration rollers R51 and R52 are disposed at a distance of about 50 mm away from a nip portion N1 where an electrostatic latent image carrier (photosensitive drum) 14 and a transfer roller 17*a* contact each other.

FIGS. 7(*a*) and 7(*b*) are a chart showing operation timing of the registration rollers R51 and R52 and the pre-registration rollers R41 and R42.

Specifically, when paper P is transported on the paper transport path 28 to the registration rollers R51 and R52 and the front end of the paper P comes in contact with a nip portion N5 between the registration rollers R51 and R52, the registration rollers R51 and R52 first stop at time t1, and the pre-registration rollers R41 and R42 then stop at slightly later time t2. By introduction of such a difference between the stop times, the paper P seized by the registration rollers R51 and R52 and the pre-registration rollers R41 and R42 is held while being slightly bent or curved as shown in FIG. 6.

Thereafter, the registration rollers R51 and R52 and the pre-registration rollers R41 and R42 resume transportation of the paper P at time t3 which leads to timing with which the front end of the paper P coincides with a front end of image information developed on the electrostatic latent image carrier (photosensitive drum) 14. In this case, since the paper P is slightly bent, the timing of outputting the front end of the paper P from the registration rollers R51 and R52 can be caused to be uniform in the width direction, so that the paper P is prevented from being obliquely transported, thereby eliminating a distortion in a formed image with respect to the width direction of the paper P. Specifically, the paper P is temporarily stopped at the registration rollers R51 and R52, and while the paper P is stopped, the registration rollers R51 and R52 are used to finely adjust a position of the front end of the paper P in a direction parallel to the paper transport direction S, adjust a center position of the transported paper, correct the obliqueness of the paper P during transportation, or the like.

In such adjustment by the registration rollers R51 and R52, the center position adjustment of the transported paper is performed as follows. The amount of displacement of a center of the transported paper is detected by a detection means, such as a line sensor or the like. The registration rollers R51 and R52 are shifted by an amount corresponding to the detected amount in a direction perpendicular to the paper transport direction. Since the front end portion of the transported paper is seized (chucked) by the registration rollers R51 and R52, the movement is smoothly performed. However, the rear end portion of the transported paper is seized (chucked) by the pre-registration rollers R41 and R42, which basically do not have a movement mechanism, so that a torsion phenomenon occurs in the paper seized by the registration rollers R51 and R52 and the pre-registration rollers R41 and R42, and therefore, a wrinkle occurs when transportation is resumed.

To solve such a problem, a technique has been proposed (e.g., JP 2005-67806A).

JP 2005-67806A describes an image forming apparatus in which one (drive roller) of transport rollers immediately before registration rollers is divided into a plurality of drive roller segments. Of these segments, a pair of drive roller segments provided at laterally symmetrical positions about a paper feed center line have laterally symmetrical taper shapes which increase in thickness toward the paper feed center line, i.e., decrease in thickness toward the opposite direction. With such a configuration, when the shaft is rotated, one of the drive roller segments tends to more greatly advance the paper at a portion closer to the paper feed center line, so that a portion of the paper contacting the drive roller segment tends to turn to the left. The other drive roller segment also tends to more greatly advance a portion closer to the paper feed center line, however, the other drive roller segment has the mirror reversed shape of the one drive roller segment, so that a portion of the paper contacting the other drive roller segment tends to turn to the right. These motions take place simultaneously, so that the paper is advanced forward in a manner which smoothes a wrinkle.

According to the image forming apparatus of JP 2005-67806A described above, it is possible to reliably smooth a wrinkle of paper. However, when the torsion phenomenon occurs due to the center position adjustment by the registration rollers, a wrinkle occurs due to the torsion phenomenon when transportation is resumed, because the transport rollers (corresponding to pre-registration rollers of the present invention) immediately before the registration rollers are fixed in a direction perpendicular to the paper transport direction.

SUMMARY OF THE INVENTION

An object of the present invention is to provide an off-center adjustment apparatus which has a structure in which pre-registration rollers are movable, so that transportation can be resumed without impairing the center position adjustment of transported paper by the registration rollers, and further, without the occurrence of a wrinkle or the displacement of a center position of the paper.

The present invention provides an off-center adjustment apparatus for performing center position adjustment in a direction perpendicular to a transport direction of paper, the off-center adjustment apparatus being provided in an image forming apparatus. The off-center adjustment apparatus comprises registration rollers provided upstream from an electrostatic latent image carrier, and pre-registration rollers provided upstream from the registration rollers. The center position adjustment is performed by the registration rollers being moved in the direction perpendicular to the transport direction while the paper is being temporarily stopped with a front end thereof being seized by the registration rollers and a rear end thereof being seized by the pre-registration rollers. The pre-registration rollers are freely movable in the direction perpendicular to the transport direction.

The pre-registration roller may be movable in the direction perpendicular to the transport direction due to elastic restoring force caused by a torsion phenomenon of the paper occurring along with movement of the registration rollers.

The pre-registration rollers may include a drive roller and an idler roller, and at least one of the drive roller and the idler roller may be freely movable. Further, the following configuration may be provided. Specifically, the roller is loosely fitted with a rotation shaft, while an elastic member is interposed between the rotation shaft and the roller. The elastic member is provided on both left and right sides of the roller where the direction perpendicular to the transport direction is assumed to be the lateral direction. The roller is seized from both the left and right sides by the elastic members. The roller is held at a normal position due to biasing force of the elastic members when paper is not seized. The roller is moved in the lateral direction due to elastic restoring force of a torsion phenomenon of the paper, resisting the biasing force of the elastic members when paper is seized. The roller returns to the normal position due to the biasing force of the elastic members after the paper has passed through the roller. The biasing forces of the elastic members are set to be weaker than the elastic restoring force of the torsion phenomenon of paper.

The roller may be divided into a plurality of roller segments along the direction perpendicular to the transport direction, and each roller segment may be freely movable. In such a configuration, elastic members are provided on both left and right sides of each roller segment. Each roller segment is held at the normal position due to the biasing forces of both the elastic members.

Thus, according to the off-center adjustment apparatus of the present invention, since the pre-registration rollers are movable in the direction perpendicular to the transport direction, transportation of temporarily stopped paper can be resumed without impairing the center position adjustment of the transported paper by the registration rollers, and further, without the occurrence of a wrinkle or the displacement of a center position of the paper.

BRIEF DESCRIPTION OF THE DRAWINGS

FIG. 2(*a*) is a side view, and FIG. 2(*b*) is a plan view.

FIG. 4(*a*) is a cross-sectional, partially cut-away view as viewed the front, and FIG. 4(*b*) is a cross-sectional view as viewed from the side.

FIG. 6 is a diagram for describing a configuration of a paper transport path before a transfer portion.

FIGS. 7(*a*) and 7(*b*) are a chart showing operation timing of registration rollers and pre-registration rollers.

DESCRIPTION OF THE PREFERRED EMBODIMENTS

Hereinafter, an off-center adjustment apparatus according to an embodiment of the present invention will be described with reference to the accompanying drawings.

Figure 1:
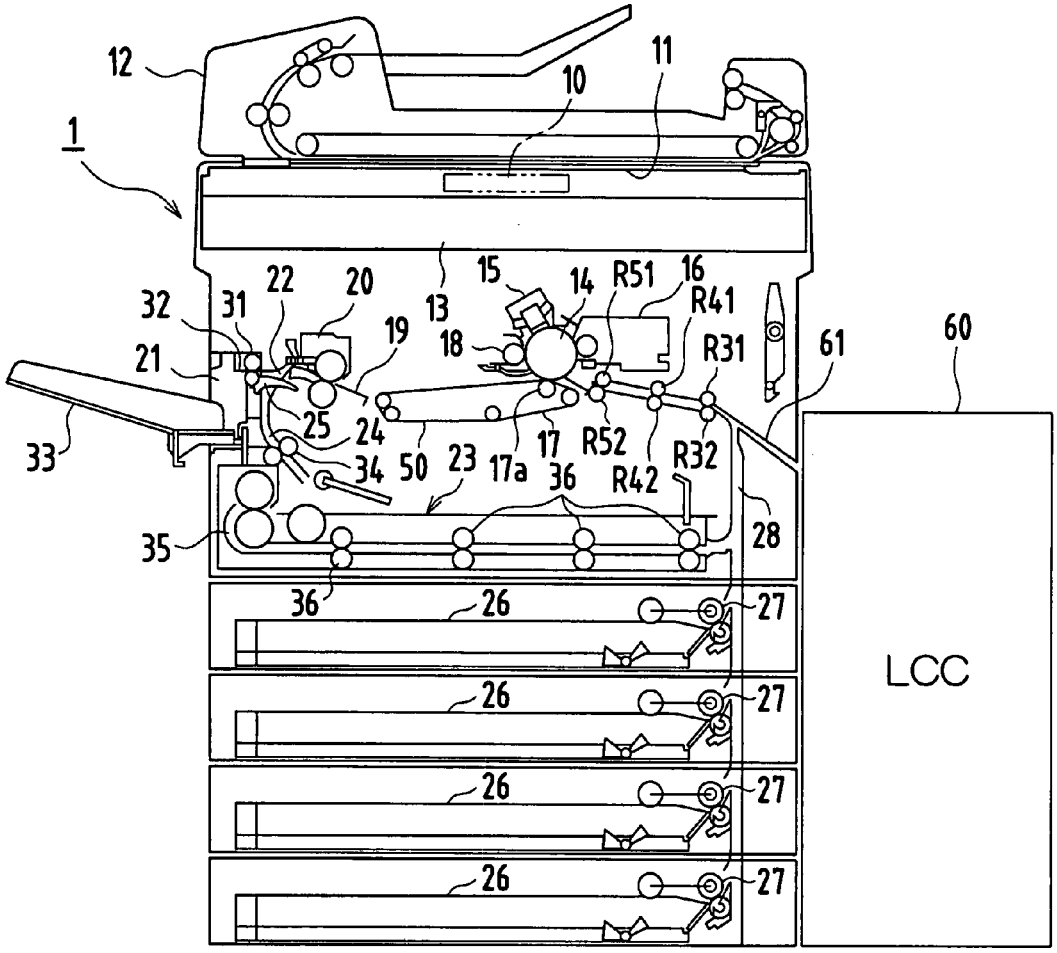
FIG. 1 is a side view showing a whole configuration of an image forming apparatus comprising an off-center adjustment apparatus of the present invention.

FIG. 1 is a side view showing a whole configuration of an image forming apparatus comprising the off-center adjustment apparatus of this embodiment.

The image forming apparatus 1 is a digital image forming apparatus which has modes of, for example, copier, printer, scanner, and fax machine, and is provided with an operation panel 10 on a front surface thereof.

An original stage 11 formed of hard and transparent glass is provided on an upper surface of the image forming apparatus 1. An automatic original feed apparatus 12 is provided above the original stage 11. An optical unit 13 is provided below the original stage 11.

A photosensitive drum 14 whose surface is formed of a photoconductive material is rotatably supported below the optical unit 13. Around the photosensitive drum 14, a charging apparatus 15, a development apparatus 16, a transfer unit 17, and a cleaner 18 are provided, facing the circumferential surface of the photosensitive drum 14.

When the image forming apparatus 1 thus configured is instructed by an operation of the operation panel 10 to start an image forming process, the optical unit 13 scans an image surface of an original placed on the original stage 11. In this case, light which is emitted by a copy lamp provided in the optical unit 13 is reflected from the original image surface, and the surface of the photosensitive drum 14 is then irradiated with the reflected light.

Prior to irradiation with the reflected light from the original, the surface of the photosensitive drum 14 is uniformly electrified with electrical charges having the same polarity by the charging apparatus 15. An electrostatic latent image is formed on the surface of the photosensitive drum 14 by a photoconductive action due to irradiation with the reflected light from the original. Developer is supplied from the development apparatus 16 to the surface of the photosensitive drum 14 on which the electrostatic latent image has been formed, so that the electrostatic latent image is developed into a developer image.

A fixing unit 20 comprising a hot roller and a pressure roller is provided downstream from the photosensitive drum 14. A transfer belt 50 of the transfer unit 17 and a paper guide 19 are provided between the fixing unit 20 and the photosensitive drum 14. The transfer belt 50 and the paper guide 19 form a paper transport path extending from the photosensitive drum 14 to the fixing unit 20.

A paper discharge tray 33 is provided on a side surface of the image forming apparatus 1, and a paper discharge transport path 22 is formed between the fixing unit 20 and the paper discharge tray 33. A portion of the paper discharge transport path 22 is branched into a re-transport path 24 which extends via a branch gate 25 to a reversing automatic paper feed apparatus 23 provided below the photosensitive drum 14.

Four paper feed cassettes 26 which are detachably attached through the front surface of the image forming apparatus 1 are provided in a lower portion of the image forming apparatus 1. The paper feed cassettes 26 house paper of respective different sizes. Prior to rotation of the photosensitive drum 14, paper is fed from any one of the four paper feed cassettes 26 via a paper feed roller 27. The fed paper is transported via a common transport path 28 toward the photosensitive drum 14 by the transport rollers R31 and R32. Thereafter, the paper is stopped with the rear end being seized by the pre-registration rollers R41 and R42 and the front end being in contact with the registration rollers R51 and R52. This portion has the same configuration as that shown in FIG. 6. Also, the registration rollers R51 and R52 and the pre-registration rollers R41 and R42 have the same operation timing as that shown in FIGS. 7(*a*) and 7(*b*).

The image forming apparatus 1 of this embodiment also comprises a large capacity paper feed unit (LCC) 60. The structure of the large capacity paper feed unit 60 will not be described in detail. Paper fed from the large capacity paper feed unit 60 is transported by the transport rollers R31 and R32 toward the photosensitive drum 14 via a unit-side transport path 61 which merges into the common transport path 28 before the transport rollers R31 and R32. Thereafter, the paper is stopped with the rear end being seized by the pre-registration rollers R41 and R42 and the front end being in contact with the registration rollers R51 and R52.

The registration rollers R51 and R52 are rotated in synchronization with rotation of the photosensitive drum 14, thereby leading paper to a nip portion (image formation region) N1 between the photosensitive drum 14 and the transfer unit 17. The paper disposed in the image formation region is subjected to corona discharge by the transfer unit 17 so that a developer image carried on the surface of the photosensitive drum 14 is transferred to a surface of the paper.

The paper on which the developer image has been transferred is transported along the transfer belt 50 and the paper guide 19 to the fixing unit 20. In the fixing unit 20, the paper is heated and pressed so that the developer image is fused and fixed to the surface of the paper.

During a one-side printing mode in which an image is printed on one side of paper, the paper which has passed through the fixing unit 20 is discharged via the paper discharge transport path 22 through a paper discharge slot 32 onto the paper discharge tray 33 by a paper discharge roller 31. In this case, the paper discharge roller 31 is reciprocatively driven in the paper transport direction by a paper discharge roller driving portion (not shown).

During a both-side printing mode in which images are printed on both sides of paper, the branch gate 25 overlaps a portion of the paper discharge transport path 22, the paper which has passed through the fixing unit 20 is transported via the re-transport path 24 comprising a transport roller 34 to the reversing automatic paper feed apparatus 23. The transport direction of the paper transported in the reversing automatic paper feed apparatus 23 is reversed and fed by paper re-feed rollers 35. The paper is transported via the common transport path 28 toward the photosensitive drum 14 again by re-transport rollers 36 with the front and back sides of the paper being reversed. Thereafter, the paper is stopped with the rear end being seized by the pre-registration rollers R41 and R42 and the front end being in contact with the registration rollers R51 and R52.

Figure 2A:
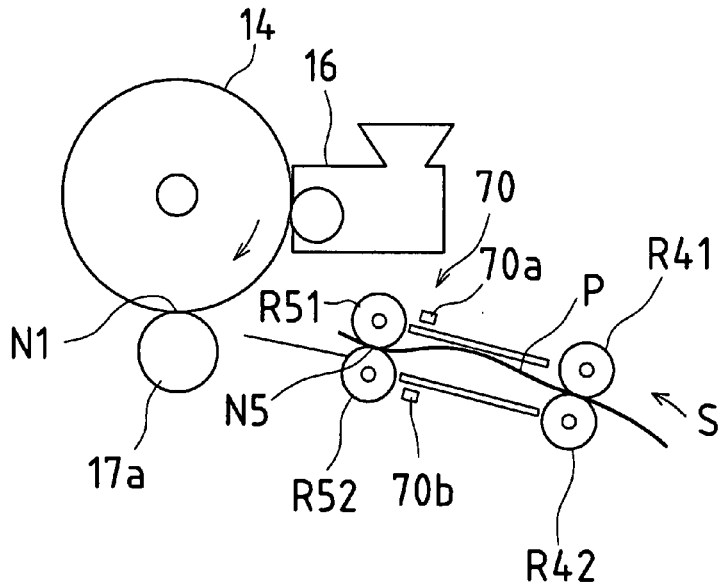
FIGS. 2(*a*) and 2(*b*) show an exemplary configuration of a paper transport position detecting means for detecting a paper transport position of stopped paper seized by registration rollers and pre-registration rollers.
Figure 2B:
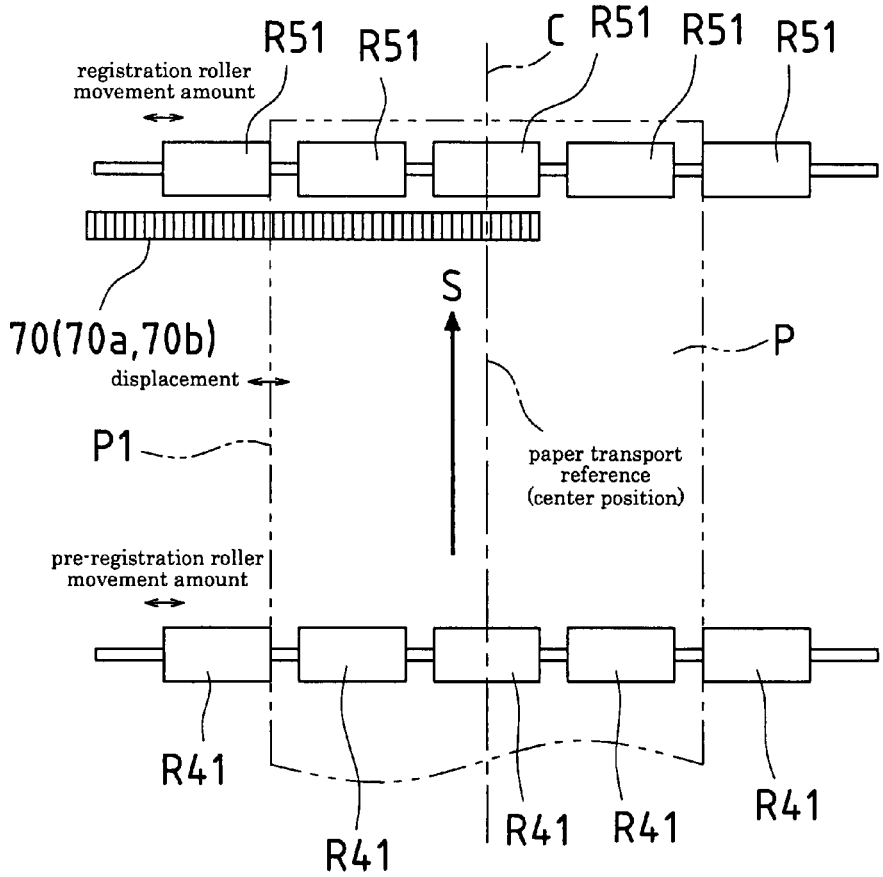

FIGS. 2(*a*) and 2(*b*) show an exemplary configuration of a paper transport position detecting means 70 for detecting a paper transport position (a displacement from a paper transport reference (center position) C) of the stopped paper P seized by the registration rollers R51 and R52 and the pre-registration rollers R41 and R42.

As shown in FIG. 2(*b*), the registration rollers R51 and R52 and the pre-registration rollers R41 and R42 include five pairs of registration rollers R51 and R52 and five pairs of pre-registration rollers R41 and R42, respectively, which are arranged at predetermined intervals in a lateral direction (a direction perpendicular to the paper transport direction). The paper transport position detecting means 70 is provided in the vicinity of the registration rollers R51 and R52. Specifically, a light emitting-side line sensor 70*a* and a light receiving-side line sensor 70*b* constituting the paper transport position detecting means 70 are vertically provided, facing each other via the paper transport path (FIG. 2(*a*)), and are laterally arranged along the registration rollers R51 and R52 (FIG. 2(*b*)). The paper transport position detecting means 70 thus arranged is formed to have a length which can cover a minimum width (e.g., a postcard size) to a maximum width (e.g., an A3 portrait size) of the transported paper P so that one side edge P1 of the paper P can be detected.

Figure 3:
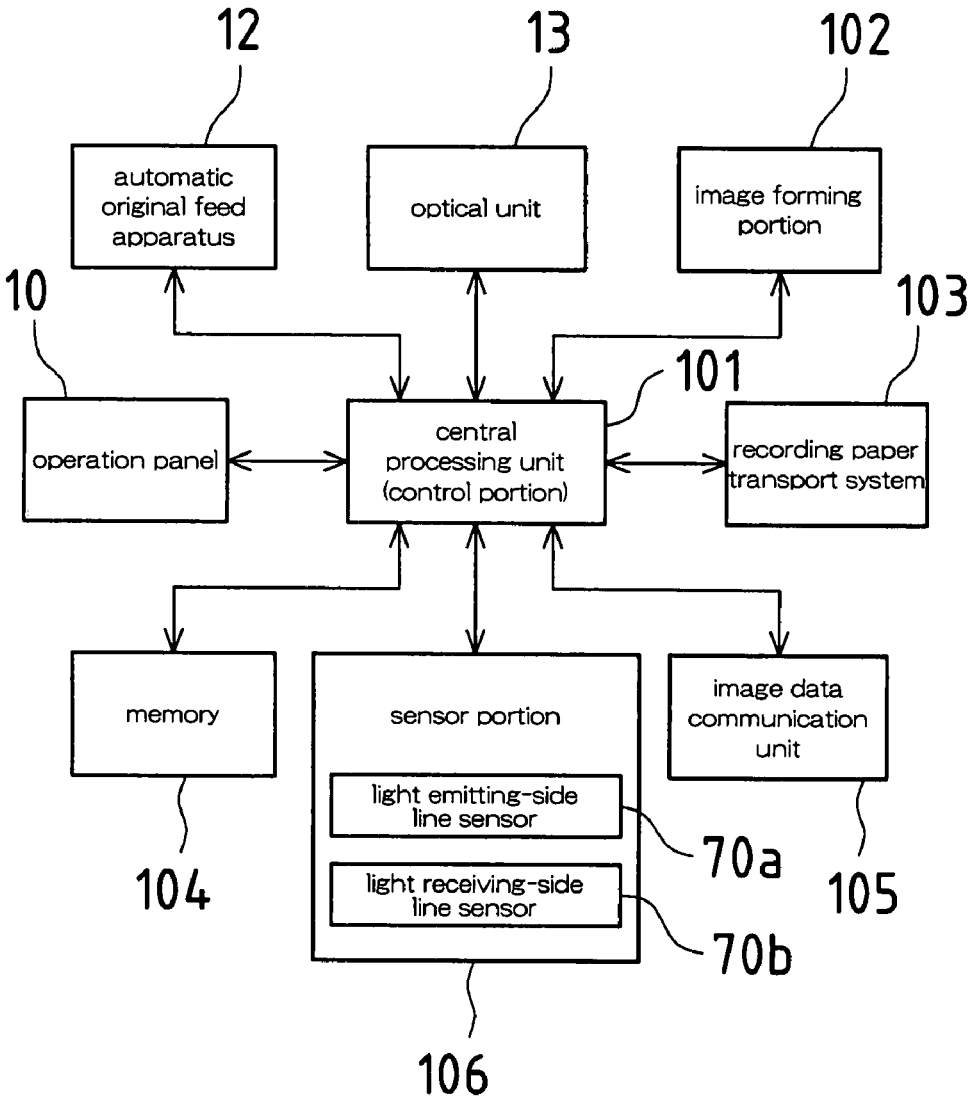
FIG. 3 is a block diagram showing a configuration of a control system of the image forming apparatus of the present invention.

Next, a configuration of a control system of the image forming apparatus 1 thus configured will be described with reference to a block diagram shown in FIG. 3.

A central processing unit (control portion) 101 manages, by a sequential control, drive mechanism portions included in the image forming apparatus 1, such as the automatic original feed apparatus 12, the optical unit 13, an image forming portion 102, a paper transport system 103, and the like, and outputs a control signal to each portion based on a detection value of a sensor portion 106 including the paper transport position detecting means 70 (the light emitting-side line sensor 70*a* and the light receiving-side line sensor 70*b*).

The operation panel 10 is connected to the control portion 101 in a manner which enables the operation panel 10 and the control portion 101 to mutually communicate with each other. The image forming apparatus 1 is operated under printing process conditions which are set and input by the user operating the operation panel 10.

Also, a memory 104 and an image data communication unit 105 are connected to the control portion 101. In the memory 104, various pieces of control information required to control the drive mechanism portions included in the image forming apparatus 1 are stored. Also in the memory 104, a detection value indicating a position in a lateral direction (a distance from the paper transport reference (center position) C) of one side edge P1 of the paper P detected by the paper transport position detecting means 70, is stored. The image data communication unit 105 is a communication unit provided for enabling information communication of image information, an image control signal or the like with other digital image apparatuses.

The control portion 101 performs a printing process control under printing process conditions which have been input and set by the user operating the operation panel 10. In this case, the control portion 101 controls the paper transport system 103 based on a detection value of the paper transport position detecting means 70 to move the registration rollers R51 and R52 in the lateral direction, thereby performing center position adjustment with respect to transported paper.

Note that various conventional well-known mechanism structures are applicable as the mechanism for moving the registration rollers R51 and R52 in the lateral direction, which, therefore, is not shown. For example, an eccentric cam is provided in sliding contact with end surfaces of rotation shafts of the registration rollers R51 and R52. By rotating the eccentric cam, the rotation shaft can be moved in the lateral direction.

In this case, the pre-registration rollers R41 and R42 can be moved in the lateral direction by elastic restoring force caused by a torsion phenomenon of the paper P occurring when the registration rollers R51 and R52 are moved.

Figure 4A:
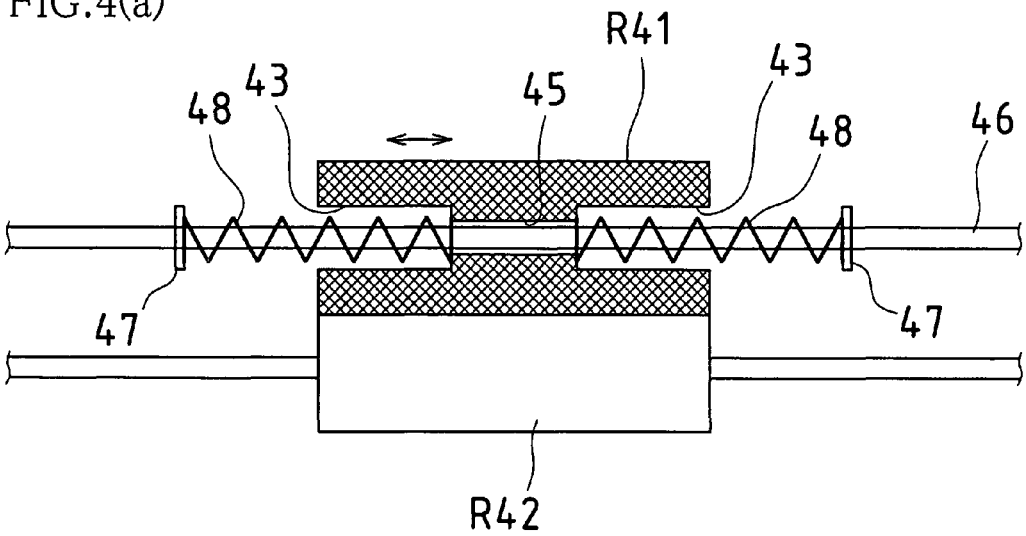
FIGS. 4(*a*) and 4(*b*) show an exemplary mechanism structure for moving the pre-registration rollers in a lateral direction.
Figure 4B:
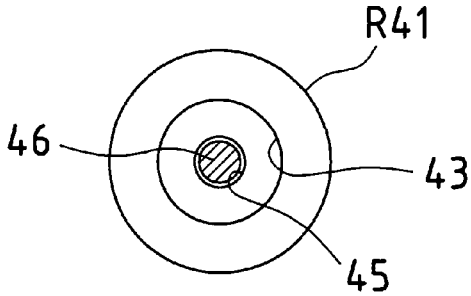

FIGS. 4(*a*) and 4(*b*) show an exemplary mechanism structure for moving the pre-registration rollers R41 and R42 in the lateral direction.

Of the drive roller R42 and the idler roller R41 consisting of the pre-registration rollers R41 and R42, the idler roller R41 has a movable mechanism structure in this embodiment.

Specifically, laterally symmetrical concave groove portions 43 and 43 are formed at middle portions of both end surfaces of the idler roller R41 having a cylindrical shape. An insertion through-hole 45 for inserting a rotation shaft 46 is formed in a bottom surface of the concave groove portion 43. In the idler roller R41, the rotation shaft 46 is simply inserted through the insertion through-hole 45, i.e., the idler roller R41 is loosely fitted with the rotation shaft 46. On the other hand, collar-shaped stopper portions 47 and 47 are formed on the rotation shaft 46 and are located on both left and right sides of the idler roller R41 when the idler roller R41 has been inserted and disposed at a normal position. Coil springs 48 and 48 are attached between the stopper portions 47 and the base surfaces of the concave groove portions 43 of the idler roller R41 while being slightly compressed. In other words, the idler roller R41 is seized from both left and right sides thereof by both the coil springs 48 and 48. By being seized by the coil springs 48 and 48, the idler roller R41 is held at a normal position (a position shown in FIG. 4(*a*)), facing the drive roller R42.

Specifically, the idler roller R41, when paper is not seized, is held at the normal position due to balance between biasing forces of the coil springs 48 and 48. When paper is seized, the idler roller R41 is moved in the lateral direction by the elastic restoring force of the paper torsion phenomenon, resisting the biasing forces of the coil springs 48 and 48. Thereby, the paper torsion phenomenon is eliminated. After paper has passed through the idler roller R41, the idler roller R41 returns to the normal position due to balance between the biasing forces of both the coil springs 48 and 48.

As can be understood by the above description, in this embodiment, the biasing forces of the coil springs 48 are set to be weaker than the elastic restoring force of the paper torsion phenomenon.

Figure 5:
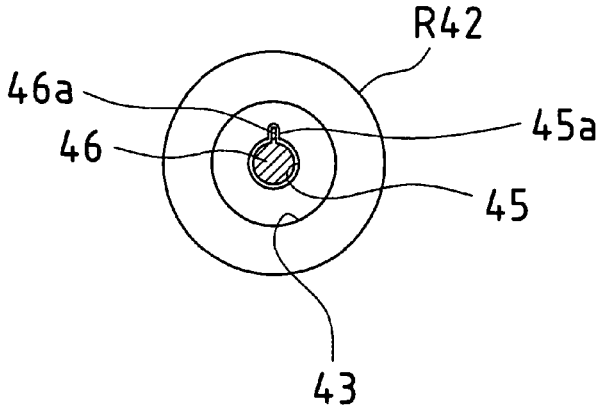
FIG. 5 is a cross-sectional view showing an example of a regulation structure for regulating a drive roller and a rotation shaft to be rotated together.

Although the movement mechanism structure is provided in the idler roller R41 in the above-described embodiment, the movement mechanism structure may be provided in the drive roller R42. In this case, when the drive roller R42 is freely rotated with respect to its rotation shaft, driving force cannot be transferred. To avoid this, the drive roller R42 needs to be regulated so that the drive roller R42 is rotated together with the rotation shaft in the rotation direction. FIG. 5 shows an example of such a regulation structure.

Specifically, the movement mechanism structure itself is the same as that shown in FIGS. 4(*a*) and 4(*b*). In FIG. 5, however, a guide piece 46*a* protruding along an axial center direction is formed on a circumferential surface of the rotation shaft 46 of the drive roller R42, and a concave guide groove portion 45*a* is formed, facing the guide piece 46*a*, along the axial center direction in an inner circumferential surface of the insertion through-hole 45 of the drive roller R42. When the rotation shaft 46 is inserted into the insertion through-hole 45, the guide piece 46*a* is inserted into the guide groove portion 45*a*. Thereby, when the rotation shaft 46 is rotated, the guide piece 46*a* is engaged with the guide groove portion 45*a*, so that the drive roller R42 is rotated together with the rotation shaft 46. In other words, the drive roller R42 is rotated together with the rotation shaft 46, while the drive roller R42 is slid and moved in the lateral direction along the rotation shaft 46.

Further, in the present invention, such a movement mechanism structure may be provided in both the idler roller R41 and the drive roller R42. In this case, both the drive roller R42 and the idler roller R41 are moved with respect to the elastic restoring force of paper due to the torsion phenomenon, thereby making it possible to more smoothly eliminate the paper torsion phenomenon.

Note that both the drive roller R42 and the idler roller R41 can be formed of a resin material or a rubber material. Alternatively, one of the drive roller R42 and the idler roller R41 can be formed of a resin material and the other can be formed of a rubber material. Further, for example, the drive roller R42 may be formed of a metal. In this case, by applying a voltage to the drive roller R42, paper debris occurring in the paper transport path can be adsorbed and removed. In this case, a removal blade is provided in contact with the surface of the drive roller R42, and a collection box for collecting the paper debris is provided below the removal blade.

Although the drive rollers R42 and the idler rollers R41 have one-to-one correspondence in the embodiment, the present invention is not limited to this. For example, horizontally long drive roller(s) may be provided, while a plurality (e.g., three) of idler rollers may be provided for each drive roller, facing the drive roller.

Regarding industrial applicability, an image processing apparatus comprising the off-center adjustment apparatus of the present invention is suitable for a high-speed digital multifunction machine which has modes of copier, printer, scanner, and fax machine and performs a high-speed printing process to produce a large amount of printed materials.

The present invention can be embodied and practiced in other different forms without departing from the gist and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An off-center adjustment apparatus for performing center position adjustment in a direction perpendicular to a transport direction of paper, the off-center adjustment apparatus being provided in an image forming apparatus, the off-center adjustment apparatus comprising:

registration rollers provided upstream from an electrostatic latent image carrier; and pre-registration rollers provided upstream from the registration rollers, wherein the center position adjustment is performed by the registration rollers being moved in the direction perpendicular to the transport direction while the paper is being temporarily stopped with a front end thereof being seized by the registration rollers and a rear end thereof being seized by the pre-registration rollers, the pre-registration rollers are freely movable in the direction perpendicular to the transport direction, and the at least one of the pre-registration rollers is loosely fitted with a rotation shaft, while an elastic member is interposed between the rotation shaft and the at least one of the pre-registration rollers.

2. The off-center adjustment apparatus according to claim 1, wherein the pre-registration rollers are movable in the direction perpendicular to the transport direction due to elastic restoring force caused by a torsion phenomenon of the paper occurring along with movement of the registration rollers.

3. The off-center adjustment apparatus according to claim 1, wherein the pre-registration rollers include a drive roller and an idler roller, and at least one of the drive roller and the idler roller is freely movable.

4. An off-center adjustment apparatus for performing center position adjustment in a direction perpendicular to a transport direction of paper, the off-center adjustment apparatus being provided in an image forming apparatus, the off-center adjustment apparatus comprising:

registration rollers provided upstream from an electrostatic latent image carrier; and pre-registration rollers provided upstream from the registration rollers, wherein the center position adjustment is performed by the registration rollers being moved in the direction perpendicular to the transport direction while the paper is being temporarily stopped with a front end thereof being seized by the registration rollers and a rear end thereof being seized by the pre-registration rollers, the pre-registration rollers are freely movable in the direction perpendicular to the transport direction, the pre-registration rollers include a drive roller and an idler roller, at least one of the drive roller and the idler roller is freely movable, the at least one of the pre-registration rollers is loosely fitted with a rotation shaft, while an elastic member is interposed between the rotation shaft and the at least one of the pre-registration rollers, the at least one of the pre-registration rollers is held at a normal position due to biasing force of the elastic member when the paper is not seized, the at least one of the pre-registration rollers is moved in the direction perpendicular to the transport direction due to elastic restoring force of a torsion phenomenon of the paper, resisting the biasing force of the elastic member, when the paper is seized, and the at least one of the pre-registration rollers returns to the normal position due to the biasing force of the elastic member after the paper has passed through the at least one of the pre-registration rollers.

5. The off-center adjustment apparatus according to claim 3, wherein the at least one of the pre-registration rollers is divided into a plurality of roller segments along the direction perpendicular to the transport direction, and each roller segment is freely movable.

6. The off-center adjustment apparatus according to claim 4, wherein the at least one of the pre-registration rollers is divided into a plurality of roller segments along the direction perpendicular to the transport direction, and each roller segment is freely movable.

7. The off-center adjustment apparatus according to claim 2, wherein the pre-registration rollers include a drive roller and an idler roller, and at least one of the drive roller and the idler roller is freely movable.

* * * * *